US008646862B2

(12) United States Patent
Wu et al.

(10) Patent No.: US 8,646,862 B2
(45) Date of Patent: Feb. 11, 2014

(54) SYSTEM AND METHOD FOR DETECTION AND COMPENSATION OF INOPERABLE INKJETS IN AN INKJET PRINTING APPARATUS

(75) Inventors: Wencheng Wu, Webster, NY (US); Beilei Xu, Penfield, NY (US); David A. Mantell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 171 days.

(21) Appl. No.: 13/407,437

(22) Filed: Feb. 28, 2012

(65) Prior Publication Data

US 2013/0222455 A1 Aug. 29, 2013

(51) Int. Cl.
*B41J 29/38* (2006.01)
*B41J 29/393* (2006.01)
*B41J 2/045* (2006.01)

(52) U.S. Cl.
CPC ..... *B41J 2/04543* (2013.01); *B41J 2/04545* (2013.01)
USPC ..... 347/13; 347/14; 347/19

(58) Field of Classification Search
USPC ..... 347/13–14, 19
See application file for complete search history.

(56) References Cited

U.S. PATENT DOCUMENTS 5,210,547 A 5/1993 Watanabe et al.
6,572,213 B2 6/2003 Valero
6,695,435 B1 2/2004 Cheng et al.
7,039,348 B2 5/2006 Kerxhalli et al.
7,382,507 B2 6/2008 Wu
7,424,169 B2 9/2008 Viassolo et al.
7,427,118 B2 9/2008 Mizes et al.
7,455,387 B2 11/2008 Cunnington et al.
7,690,746 B2 4/2010 Mantell et al.
7,905,567 B2 3/2011 Orsley
2004/0027618 A1 2/2004 Nakamura et al.
2006/0050099 A1* 3/2006 Murakami et al. ..... 347/19
2007/0070108 A1* 3/2007 Mantell et al. ..... 347/19
2008/0303854 A1 12/2008 Mizes et al.
2009/0262380 A1 10/2009 Puigardeu et al.
2010/0021069 A1 1/2010 Fan et al.
2010/0123752 A1 5/2010 Eun et al.
2010/0124362 A1 5/2010 Wu et al.
2010/0149560 A1 6/2010 Wu
2010/0214580 A1 8/2010 Burry et al.
2010/0238220 A1 9/2010 Yeh et al.
2010/0245454 A1 9/2010 Ramakrishnan et al.
2010/0253732 A1 10/2010 Sjolander et al.

* cited by examiner

*Primary Examiner* — Jason Uhlenhake
(74) *Attorney, Agent, or Firm* — Maginot, Moore & Beck, LLP

(57) ABSTRACT

In an inkjet printer, a method for of compensating for defects in printed images identifies a cross-process direction location of a defect in a printed image and a candidate inkjet corresponding to the location of the defect. The method modifies the operation of the candidate inkjet to form a second ink image. The method identifies a second inkjet that actually formed the first image defect in response to identifying a second defect in the second ink image located proximate to the first defect. The method enables identification and compensation of inoperable inkjets when image data do not correspond perfectly to inkjets in the printer.

20 Claims, 12 Drawing Sheets

SYSTEM AND METHOD FOR DETECTION AND COMPENSATION OF INOPERABLE INKJETS IN AN INKJET PRINTING APPARATUS

CROSS-REFERENCE

Reference is made to commonly-assigned copending U.S. patent application Ser. No. 13/008,557 entitled "CONTENT-AWARE IMAGE QUALITY DEFECT DETECTION IN PRINTED DOCUMENTS" by Wu et al. filed Jan. 18, 2011, the entire disclosure of which is expressly incorporated by reference herein.

TECHNICAL FIELD

This document relates generally to printers that generate ink images on media, and more particularly, to printers that identify defects in the ink images.

BACKGROUND

Printers form ink images on media, which include paper and other print media. Different imaging or printing techniques, which include laser printing, inkjet printing, offset printing, dye-sublimation printing, thermal printing, and the like, can be used to produce printed documents. In particular, inkjet printers eject liquid ink from printheads to form images on an image receiving member surface. The printheads include a plurality of inkjets that are arranged in some type of array. Each inkjet has a thermal or piezoelectric actuator that is coupled to a printhead controller. The printhead controller generates firing signals that correspond to digital data for images. The printhead actuators respond to the firing signals by ejecting ink drops onto an image receiving member surface to form an ink image that corresponds to the digital data for the images used to generate the firing signals. The size of the ink drops and the timing of the ejection of the ink drops are affected by the frequency and amplitude of the firing signals.

Throughout the life cycle of a printer, the image generating ability of the device requires evaluation and, if the images contain detectable defects, correction. Various defects in the image generating process affect ink image quality. In an inkjet printer, one such defect occurs when an individual inkjet becomes inoperable as either a "weak" or "missing" inkjet. A weak inkjet intermittently ejects ink drops or ejects ink drops having a mass that is different than expected for the firing signal used to operate the actuator for the inkjet. A missing inkjet fails to eject ink drops entirely. Inoperable inkjets, including both weak and missing inkjets, negatively impact the quality of printed images.

Some existing printers are configured to detect and compensate for inoperable inkjets. Identifying inoperable inkjets typically requires the printing of reference patterns, which are specially designed, arranged ink lines printed on the image receiving member surface. These reference patterns are printed separately from the ink images forming a print job. Consequently, the printing of reference patterns absorbs a portion of the resources used for productive printing. Because a printhead often includes hundreds or thousands of individual inkjets, correct identification of a single inoperable inkjet presents challenges. In some imaging devices, an optical sensor is used to generate image data of the reference pattern on an image receiving member surface and these data are analyzed and correlated to inkjet positions in a printhead to identify an inoperable inkjet. Errors in the alignment of the photosensors in the optical sensor or in the calibration of the sensor along with distortions that arise from media shifting during operation of the printer affect the accuracy of the analysis of the image data of the reference pattern. In a situation where a printer incorrectly identifies an inoperable inkjet, the printer operates inkjets that are located near the identified inkjet to compensate for a perceived image defect produced by an inoperable inkjet. Compensating for the incorrectly identified inkjet, however, introduces image defects that compound the defects produced by the inoperable inkjets. Consequently, improvements to the identification and compensation for inoperable inkjets in an inkjet printer would be beneficial.

SUMMARY

In one embodiment, a method of compensating for defects in printed images has been developed. The method includes generating image data corresponding to a first printed image formed by a plurality of inkjets arranged in a cross-process direction in a printer, identifying a first defect in the first printed image with reference to the image data of the first printed image, identifying a candidate inkjet that generated the first defect with reference to a cross-process direction location of the first defect in the image data of the first printed image, modifying operation of the candidate inkjet to form a second printed image, generating image data corresponding to the second printed image, and identifying that a second inkjet in the plurality of inkjets other than the candidate inkjet generated the first defect in response to a second cross-process direction location of a second defect identified in the image data of the second printed image being within a predetermined cross-process direction distance of the cross-process direction location of the first defect.

In another embodiment, an inkjet printing apparatus that compensates for image defects has been developed. The printing apparatus includes a plurality of inkjets arranged in a cross-process direction across a print zone, each inkjet being configured to eject ink drops onto an image receiving surface moving past the plurality of inkjets in a process direction, a plurality of optical detectors configured in the cross-process direction across the image receiving surface, each optical detector in the plurality of optical detectors being configured to detect light reflected from the image receiving surface, and a controller operatively connected to the plurality of inkjets and the plurality of optical detectors. The controller is configured to generate a first plurality of firing signals to eject ink from the plurality of inkjets onto the image receiving member to form a first printed image, generate image data corresponding to the first printed image with the plurality of optical detectors, identify a first defect in the first printed image with reference to the image data, identify a candidate inkjet that generated the first defect with reference to a cross-process direction location of the first defect in the image data, modify generation of firing signals for the candidate inkjet in the cross-process direction to eject ink from the plurality of inkjets onto the image receiving surface to form a second printed image, generate image data corresponding to the second printed image with the plurality of optical detectors, and identify that a second inkjet in the plurality of inkjets other than the candidate inkjet generated the first defect in response to a second cross-process direction location of a second defect identified in the image data of the second printed image being within a predetermined cross-process direction distance of the cross-process direction location of the first defect.

BRIEF DESCRIPTION OF THE DRAWINGS

The foregoing aspects and other features of a system and method that identifies and compensates for inoperable inkjets with reference to defects in image data of ink images are explained in the following description, taken in connection with the accompanying drawings.

DETAILED DESCRIPTION

Figure 1:
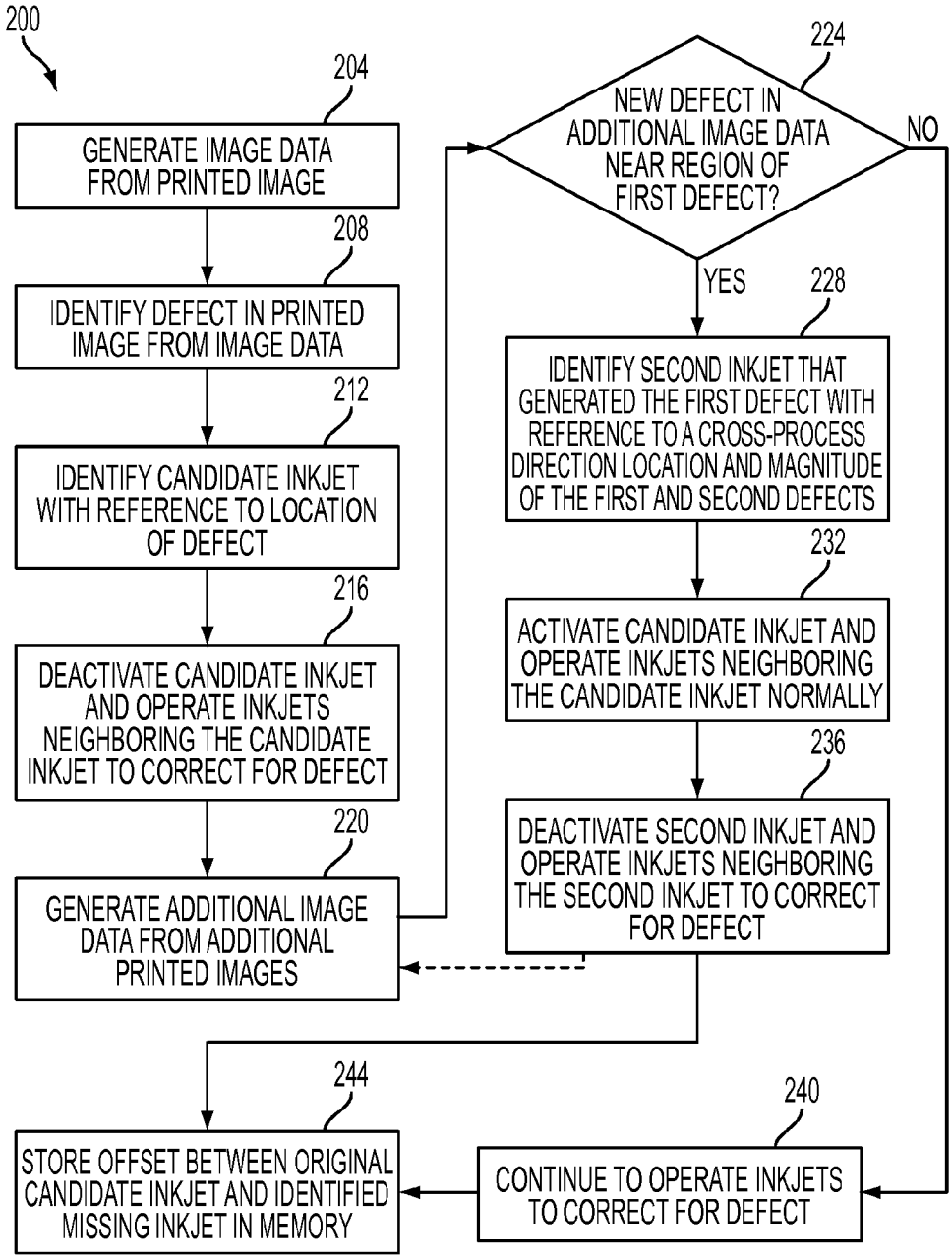
FIG. 1 is a block diagram of a process that identifies and compensates for an inoperable inkjet in an inkjet printer.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that forms ink images on media. Examples of printers include, but are not limited to, digital copiers, bookmaking machines, facsimile machines, multi-function machines, or the like. The term "image receiving member" encompasses any print medium including paper, as well as indirect imaging members, such as rotating image drums or belts. The image receiving member travels in a process direction, with a cross-process direction being perpendicular to the process direction. The term "page" refers to an area of the surface of an image receiving member that receives an ink image that corresponds to one page of a document. In a duplex printing mode, the printer forms ink images corresponding to different pages on each side of a single sheet of paper. A continuous media web typically includes a plurality of pages formed on one or both sides of the web, with a predetermined space left between adjacent printed images of each page to facilitate cutting the web into individual sheets.

The term "image data" refers to a digital representation of an ink image on an image receiving member surface that is suitable for processing by a digital device such as a microcontroller, processor, application specific integrated circuit (ASIC), and the like. The image data can be generated from an optical sensor within a printer, or can be generated by a digital device external to the printer, such as a camera, scanner, computer, or the like. The terms "duplicate image" and "duplicate image data" refer to two or more images or sets of image data, which correspond to the same or similar ink images. Duplicate images need not be exactly identical to one another. For example, duplicate images include personalized documents, such as bills or advertising materials, which include personalized information, such as text, printed on a single image such a corporate logo or letterhead. The term "print job" refers to a series of data sent to a printer that specify various job parameters, commands, and digital data for images to be printed. The digital data for each image specify various image elements, such as text and graphics. In some embodiments, a single print job instructs the printer to produce multiple copies of a single document, and in other embodiments, each print job in a plurality of print jobs instructs the printer to produce a single copy of the same document.

The surface of an image receiving member is made up of a grid-like pattern of potential drop locations, sometimes referred to as pixels. In an inkjet array, each inkjet is configured to emit ink drops that land on a pixel at a predetermined location in the cross-process direction on the image receiving member. Inkjets are arranged in the cross-process direction to enable printing of ink drops to adjacent pixels to form a continuous line of ink across the image receiving member.

As used herein, the term "reflectance value" refers to a numeric value assigned to an amount of light that is reflected from a pixel on the image receiving member. In some embodiments, the reflectance value is assigned an integer value between 0 and 255. A reflectance value of 0 represents a minimum level of reflected light, such as a pixel that is covered in black ink, and a reflectance value of 255 represents a maximum level of reflected light, such as light reflected from white paper used as an image receiving member. In other embodiments the reflectance value can be a non-integer value that covers a different numeric range. Some embodiments measure reflectance values that include multiple numeric values corresponding to different color separations such as red, green, and blue (RGB) values. In a test pattern that includes dashes printed on a highly reflective image receiving member, the image data corresponding to a dash of ink have lower image reflectance values than the surrounding image receiving member.

As used in this document, the words "calculate" and "identify" include the operation of a circuit comprised of hardware, software, or a combination of hardware and software that produces a numerical result made with reference to one or more measurements of physical relationships with accuracy or precision suitable for a practical application. Also, the description presented below is directed to a system for operating an inkjet printer to print images on an image receiving member surface and to analyze image data representing the printed images to detect transient image defects. The reader should also appreciate that the principles set forth in this description are applicable to similar printers and digital image analyzers that can be adapted for use in any printer that generates images with dots of marking material.

Figure 7:
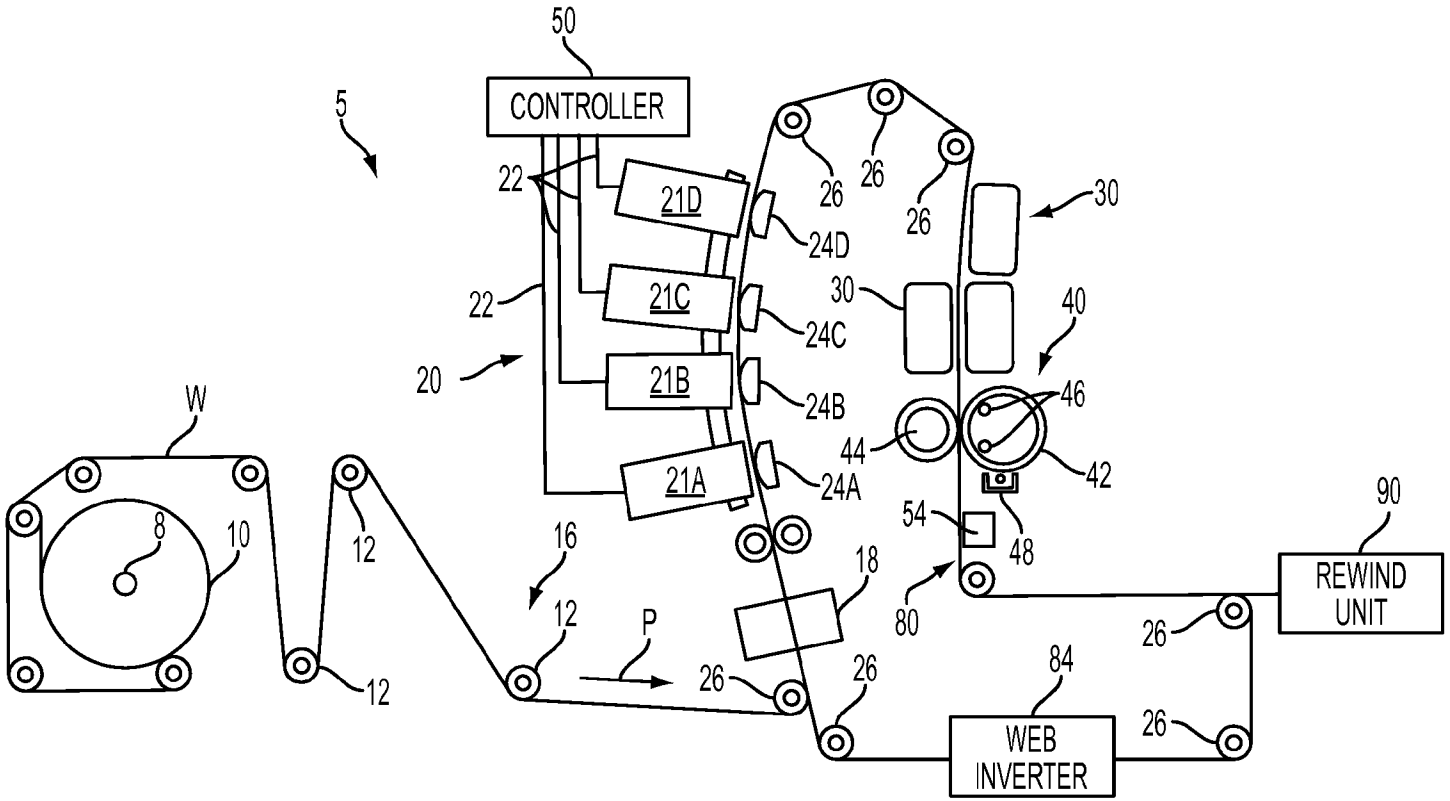
FIG. 7 PRIOR ART
FIG. 7 is a schematic view of a prior art inkjet printer.

FIG. 7 depicts a prior-art inkjet printer 5. For the purposes of this disclosure, an inkjet printer employs one or more inkjet printheads to eject drops of ink into an image receiving member such as paper, another print medium, or an indirect member such as a rotating image drum or belt. The printer 5 is configured to print ink images with a "phase-change ink," by which is meant an ink that is substantially solid at room temperature and that transitions to a liquid state when heated to a phase change ink melting temperature for jetting onto the imaging receiving member surface. The phase change ink melting temperature is any temperature that is capable of melting solid phase change ink into liquid or molten form. In one embodiment, the phase change ink melting temperature is approximately 70° C. to 140° C. In alternative embodiments, the ink utilized in the printer comprises UV curable gel ink. Gel inks are also heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

The printer 5 includes a controller 50 to process the image data before generating the control signals for the inkjet ejectors to eject colorants. Colorants can be ink, or any suitable substance that includes one or more dyes or pigments and that is applied to the selected media. The colorant can be black, or any other desired color, and some printer configurations apply a plurality of distinct colorants to the media. The media includes any of a variety of substrates, including plain paper, coated paper, glossy paper, or transparencies, among others, and the media can be available in sheets, rolls, or other physical formats.

The printer 5 is an example of a direct-to-sheet, continuous-media, phase-change inkjet printer that includes a media supply and handling system configured to supply a long (i.e., substantially continuous) web of media W of "substrate" (paper, plastic, or other printable material) from a media source, such as spool of media 10 mounted on a web roller 8. For simplex printing, the printer 5 passes the media web W through a media conditioner 16, print zone 20, printed web conditioner 80, and rewind unit 90 once. In the simplex operation, the media source 10 has a width that substantially covers the width of the rollers over which the media travels through the printer.

For duplex operations, the web inverter 84 flips the media web W over to present a second side of the media to the print zone 20 and printed web conditioner 80, before being taken up by the rewind unit 90. In duplex operation, the media source is approximately one-half of the roller widths as the web travels over one-half of the surface of each roller 26 in the print zone 20 and printed web conditioner 80. The inverter 84 flips and laterally displaces the media web W and the media web W subsequently travels over the other half of the surface of each roller 26 opposite the print zone 20 and printed web conditioner 80, for printing and conditioning of the reverse side of the media web W. The rewind unit 90 is configured to wind the web onto a roller for removal from the printer and subsequent processing.

In another duplex printing configuration, two printers with the configuration of the printer 5 are arranged serially with a web inverter interposed between the two printers to perform duplex printing operations. In the serial printing arrangement, the first printer forms and fixes an image on one side of a web, the inverter turns the web over, and the second printer forms and fixes an image on the second side of the web. In the serial duplex printing configuration, the width of the media web W can substantially cover the width of the rollers in both printers over which the media travels during duplex printing.

The media web W is unwound from the source 10 as needed and a variety of motors, not shown, rotate one or more rollers 12 and 26 to propel the media web W. The media conditioner includes rollers 12 and a pre-heater 18. The rollers 12 and 26 control the tension of the unwinding media as the media moves along a path through the printer. In alternative embodiments, the printer transports a cut sheet media through the print zone in which case the media supply and handling system includes any suitable device or structure to enable the transport of cut media sheets along a desired path through the printer. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media is transported through a print zone 20 that includes a series of color modules or units 21A, 21B, 21C, and 21D, each color module effectively extends across the width of the media and is able to eject ink directly (i.e., without use of an intermediate or offset member) onto the moving media. In printer 5, each of the printheads ejects a single color of ink, one for each of the colors typically used in color printing, namely, cyan, magenta, yellow, and black (CMYK). The controller 50 of the printer receives velocity data from encoders mounted proximately to rollers positioned on either side of the portion of the path opposite the four printheads to calculate the linear velocity and position of the web as the web moves past the printheads. The controller 50 uses these data to generate firing signals for actuating the inkjet ejectors in the printheads to enable the printheads to eject four colors of ink with appropriate timing and accuracy for registration of the differently colored patterns to form color images on the media. The inkjet ejectors actuated by the firing signals correspond to digital data processed by the controller 50. The digital data for the images to be printed can be transmitted to the printer, generated by a scanner (not shown) that is a component of the printer, or otherwise generated and delivered to the printer. In various configurations, a color module for each primary color includes one or more printheads; multiple printheads in a module are formed into a single row or multiple row array; printheads of a multiple row array are staggered; a printhead prints more than one color; or the printheads or portions thereof are mounted movably in a direction transverse to the process direction P for printing operations, such as for spot-color applications and the like.

Associated with each color module is a backing member 24A-24D, typically in the form of a bar or roll, which is arranged substantially opposite the printhead on the back side of the media. Each backing member positions the media at a predetermined distance from the printhead opposite the backing member. The backing members 24A-24D are optionally configured to emit thermal energy to heat the media to a predetermined temperature, which is in a range of about 40° C. to about 60° C. in printer 5. The various backer members can be controlled individually or collectively. The pre-heater 18, the printheads, backing members 24A-24D (if heated), as well as the surrounding air combine to maintain the media along the portion of the path opposite the print zone 20 in a predetermined temperature range of about 40° C. to 70° C.

As the partially-imaged media web W moves to receive inks of various colors from the printheads of the print zone 20, the printer 5 maintains the temperature of the media web within a given range. The printheads in the color modules 21A-21D eject ink at a temperature typically significantly higher than the temperature of the media web W. Consequently, the ink heats the media, and temperature control devices can maintain the media web temperature within a predetermined range. For example, the air temperature and air flow rate behind and in front of the media web W impacts the media temperature. Accordingly, air blowers or fans can be utilized to facilitate control of the media temperature. Thus, the printer 5 maintains the temperature of the media web W within an appropriate range for the jetting of all inks from the printheads of the print zone 20. Temperature sensors (not shown) can be positioned along this portion of the media path to enable regulation of the media temperature.

Following the print zone 20 along the media path are one or more "mid-heaters" 30. A mid-heater 30 can use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 applies heat and/or pressure to the media to fix the images to the media. The fixing assembly includes any suitable device or apparatus for fixing images to the media including heated or unheated pressure rollers, radiant heaters, heat lamps, and the like. In the embodiment of the FIG. 7, the fixing assembly includes a "spreader" 40, that applies a predetermined pressure, and in some implementations, heat, to the media. The function of the spreader 40 is flatten the individual ink droplets, strings of ink droplets, or lines of ink on web W and flatten the ink with pressure and, in some systems, heat. The spreader flattens the ink drops to fill spaces between adjacent drops and form uniform images on the media web W. In addition to spreading the ink, the spreader 40 improves fixation of the ink image to the media web W by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web W to a temperature in a range from about 35° C. to about 80° C. In alternative embodiments, the fixing assembly spreads the ink using non-contact heating (without pressure) of the media after the print zone 20. Such a non-contact fixing assembly can use any suitable type of heater to heat the media to a desired temperature, such as a radiant heater, UV heating lamps, and the like.

In one practical embodiment, the roller temperature in spreader 40 is maintained at an optimum temperature that depends on the properties of the ink, such as 55° C. Generally, a lower roller temperature gives less line spread while a higher temperature produces imperfections in the gloss of the ink image. Roller temperatures that are too high may cause ink to offset to the roll. In one practical embodiment, the nip pressure is set in a range of about 500 to about 2000 psi lbs/side. Lower nip pressure produces less line spread while higher pressure may reduce pressure roller life.

The spreader 40 can include a cleaning/oiling station 48 associated with image-side roller 42. The station 48 cleans and/or applies a layer of some release agent or other material to the roller surface. The release agent material can be an amino silicone oil having viscosity of about 10-200 centipoises. A small amount of oil transfers from the station to the media web W, with the printer 5 transferring approximately 1-10 mg per A4 sheet-sized portion of the media web W. In one embodiment, the mid-heater 30 and spreader 40 are combined into a single unit, with their respective functions occurring relative to the same portion of media simultaneously. In another embodiment the media is maintained at a high temperature as the media exits the print zone 20 to enable spreading of the ink.

Following passage through the spreader 40 the printed media can be wound onto a roller for removal from the system (simplex printing) or directed to the web inverter 84 for inversion and displacement to another section of the rollers for a second pass by the printheads, mid-heaters, spreader, and coating station. One configuration of the printer 5 winds the simplex or duplex printed media onto a roller for removal from the system by rewind unit 90. Alternatively, the media can be directed to other processing stations that perform tasks such as cutting, binding, collating, and/or stapling the media or the like.

In printer 5, a controller 50 is operatively connected to various subsystems and components to regulate and control operation of the printer 5. The controller 50 is implemented with general or specialized programmable processors that execute programmed instructions. The instructions and data required to perform the programmed functions are stored in a memory associated with the processors or controllers. The processors, their memories, and interface circuitry configure the controllers and/or print engine to perform the printer operations. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits. The controller 50 is operatively connected to the print bar and printhead motors of color modules 21A-21D in order to adjust the positions of the printhead bars and printheads in the cross-process direction across the media web W. In one embodiment, the print bar and printhead motors are electrical actuators, such as stepper motors, which enable precise adjustment of the print bars and printheads in the print zone 20.

The printer 5 includes an optical imaging system 54 that is configured in a manner similar to that described above for the imaging of the printed web. The optical imaging system is configured to detect, for example, the presence, reflectance values, and/or location of ink drops jetted onto the receiving member by the inkjets of the printhead assembly. The optical imaging system 54 includes an array of optical detectors mounted to a bar or other longitudinal structure that extends across the width of an imaging area on the image receiving member. In one embodiment in which the imaging area is approximately twenty inches wide in the cross-process direction and the printheads print at a resolution of 600 dpi in the cross-process direction, over 12,000 optical detectors are arrayed in a single row along the bar to generate a single scanline of image data corresponding to a line across the image receiving member. The optical detectors are configured in association in one or more light sources that direct light towards the surface of the image receiving member. The optical detectors receive the light generated by the light sources after the light is reflected from the image receiving member. The magnitude of the electrical signal generated by an optical detector in response to light being reflected by the bare surface of the image receiving member is larger than the magnitude of a signal generated in response to light reflected from a drop of ink on the image receiving member. This difference in the magnitude of the generated signal is used to identify the positions of ink drops on an image receiving member. The reader should note, however, that lighter colored inks, such as yellow, cause optical detectors to generate lower contrast signals with respect to the signals received from bare portions of the media web W than darker colored inks, such as black. The magnitudes of the electrical signals generated by the optical detectors are converted to digital values by an appropriate analog/digital converter.

The imaging system 5 of FIG. 7 is merely illustrative of one embodiment of an imaging system that generates image data for the detection of transient image defects in ink images on the image receiving member surface. Alternative imaging systems include, but not are not limited to, drop on demand imaging systems, sheet fed imaging systems, and the like.

FIG. 1 depicts a process 200 for identification of an inoperable inkjet in an array of inkjets during a print job. In the discussion below, a reference to the process performing a function or action refers to a controller executing programmed instructions stored in a memory to operate one or more components of the printer to perform the function or action. Process 200 is described with reference to printer 5 and controller 50 for illustrative purposes. Process 200 begins by generating image data corresponding to an ink image printed on the media web W (block 204). In the printer 5, the optical imaging system 54 generates image data corresponding to light reflected from ink images that are formed in the print zone 20 and the underlying media web W. The optical imaging system 54 generates rasterized image data, which is to say that the optical imaging system 54 generates a series of rows of image data, with each row corresponding to a single row of pixels on the media web W. The optical sensor generates successive rows of image data as the media web W moves past the optical imaging system 54 in the process direction P. The controller 50 generates a two-dimensional representation of the ink images from the series of image rows in the rasterized image data.

During a printing operation, one or more inkjets in the color modules 21A-21D may become inoperable. As used herein, the term "inoperable inkjet" refers to an inkjet that deviates from an expected mode of operation during printing. Examples of inoperable inkjets include inkjets that fail to eject ink drops entirely, operate only intermittently, and eject ink drops onto an incorrect location of the image receiving member. The controller 50 identifies an image defect that corresponds to an inoperable inkjet in the image data (block 208). One type of image defect is referred to as a "light streak." A light streak occurs in a region of a printed image that includes a linear section extending in the process direction P where the underlying image receiving member is visible instead of being covered by ink in a portion of an image that should be filled with ink. An example of a light streak occurs in a rectangular region with a dense coverage of ink printed on the image receiving member with a thin unprinted streak extending through the region in the process direction P due to an inoperable inkjet.

In one configuration, the controller 50 identifies image defects in printed regions of images that are printed multiple times during a print job without requiring direct access to the digital data of the images to be printed that are used to operate the printer 5 to print the ink images of a print job. For example, in one print job, multiple copies of a single four page document are included. The controller 50 identifies expected image data corresponding to one or more regions of the pages in print job, such as a solid rectangular region on one page of the print job. During the print job, if one of the inkjets in the print zone 20 that is responsible for printing the rectangular region becomes inoperable, then a light streak appears in the image data. The cross-referenced U.S. patent application Ser. No. 13/008,557 describes in more detail various methods for identifying image defects in printed images without a priori access to the digital data used to print ink images. In another embodiment, the controller 50 identifies defects in the image data with reference to the digital data used to print ink images. The digital data can include binary data in a rasterized image format, printer command data in a page description language (PDL), ASCII text data, or any other digital data format known to the art for controlling the formation of ink images in a printer.

Figure 3A:
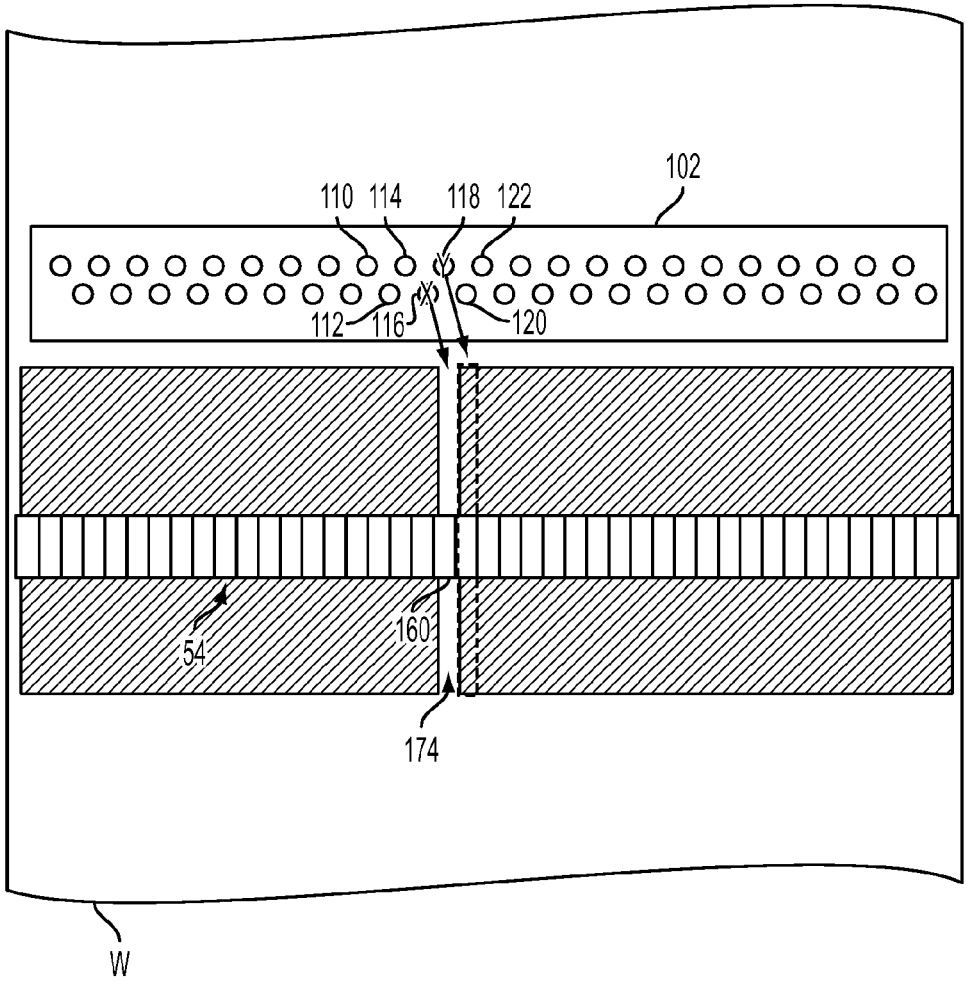
FIG. 3A is a schematic view of an inkjet printheasquatchd array and an image receiving member with a first misalignment between detected image defects and a cross-process direction location of an inoperable inkjet.

Once an image defect is identified, the controller 50 identifies a candidate inkjet that may be inoperable with reference to the cross-process direction location of the image defect (block 212). The inkjet is referred to as a "candidate" inkjet because under certain circumstances the actual inkjet that is inoperable does not correspond to the cross-process direction location of the image defect. For example, in FIG. 3A, an inkjet 116 in a printhead 102 is inoperable and a printed image includes a corresponding light streak 174. A light sensor 160 in the optical imaging system 54 detects the light streak 174, and the controller 50 identifies an image defect. In FIG. 3A, the controller 50 identifies a candidate inkjet 118 instead of the actually inoperable inkjet 116 because the light sensor 160 is aligned with the inkjet 118 instead of with the inkjet 116. The misidentification of the inoperable inkjet can occur for numerous reasons including shrinkage of the media web W, cross-process direction offset of the media web W, misalignment of the light sensors in the optical imaging system 54, and misalignments of one or more printheads in the print zone 20 relative to the optical imaging system 54.

Figure 4A:
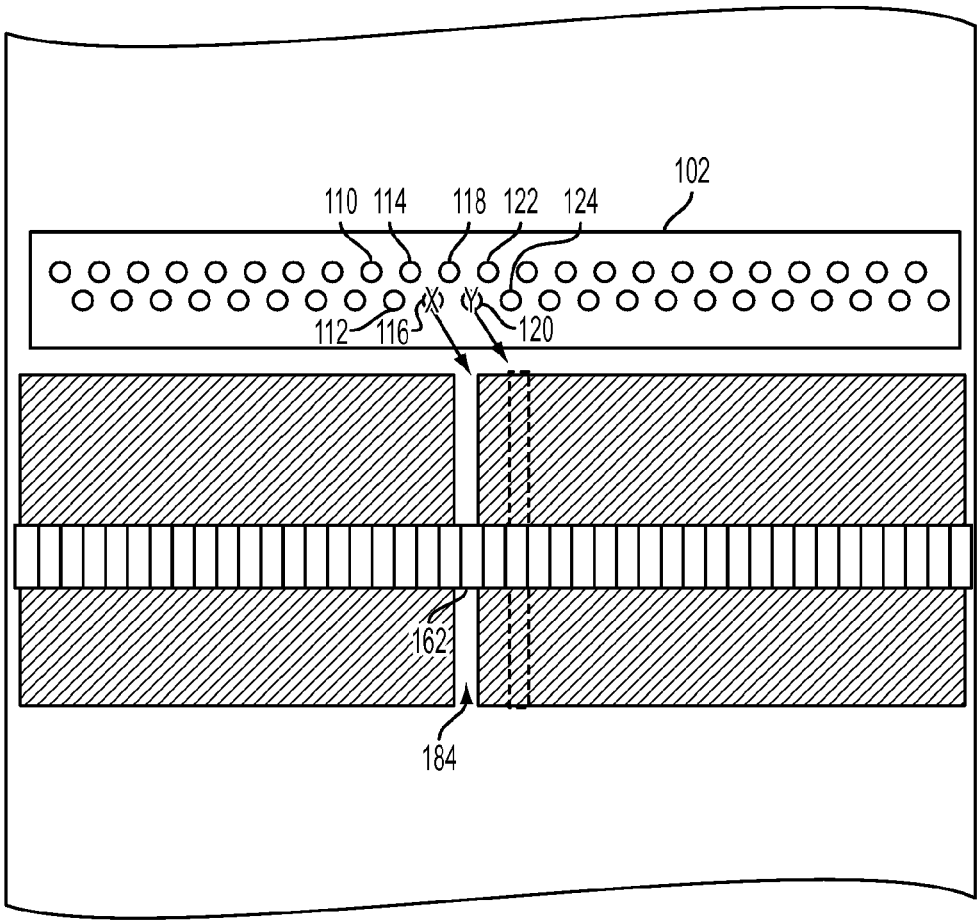
FIG. 4A is a schematic view of an inkjet printhead array and an image receiving member with a second misalignment between detected image defects and a cross-process direction location of an inoperable inkjet.
Figure 5A:
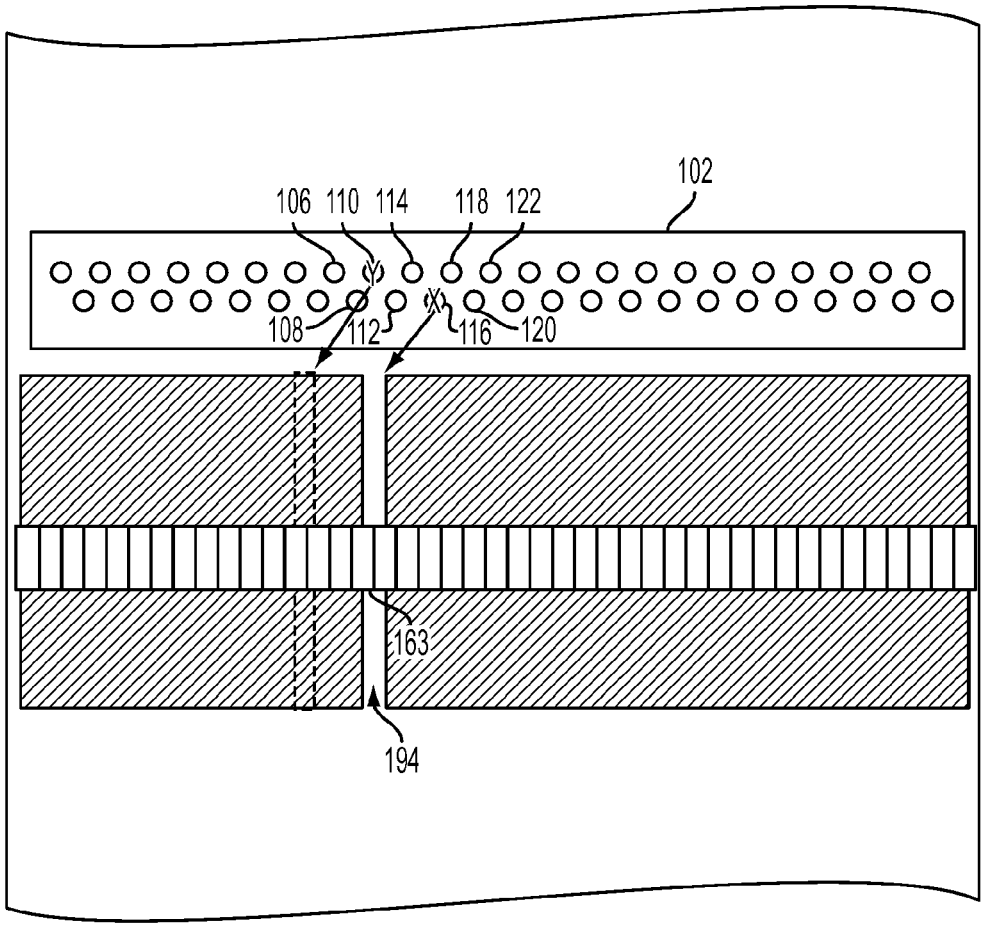
FIG. 5A is a schematic view of an inkjet printhead array and an image receiving member with a third misalignment between detected image defects and a cross-process direction location of an inoperable inkjet.
Figure 5B:
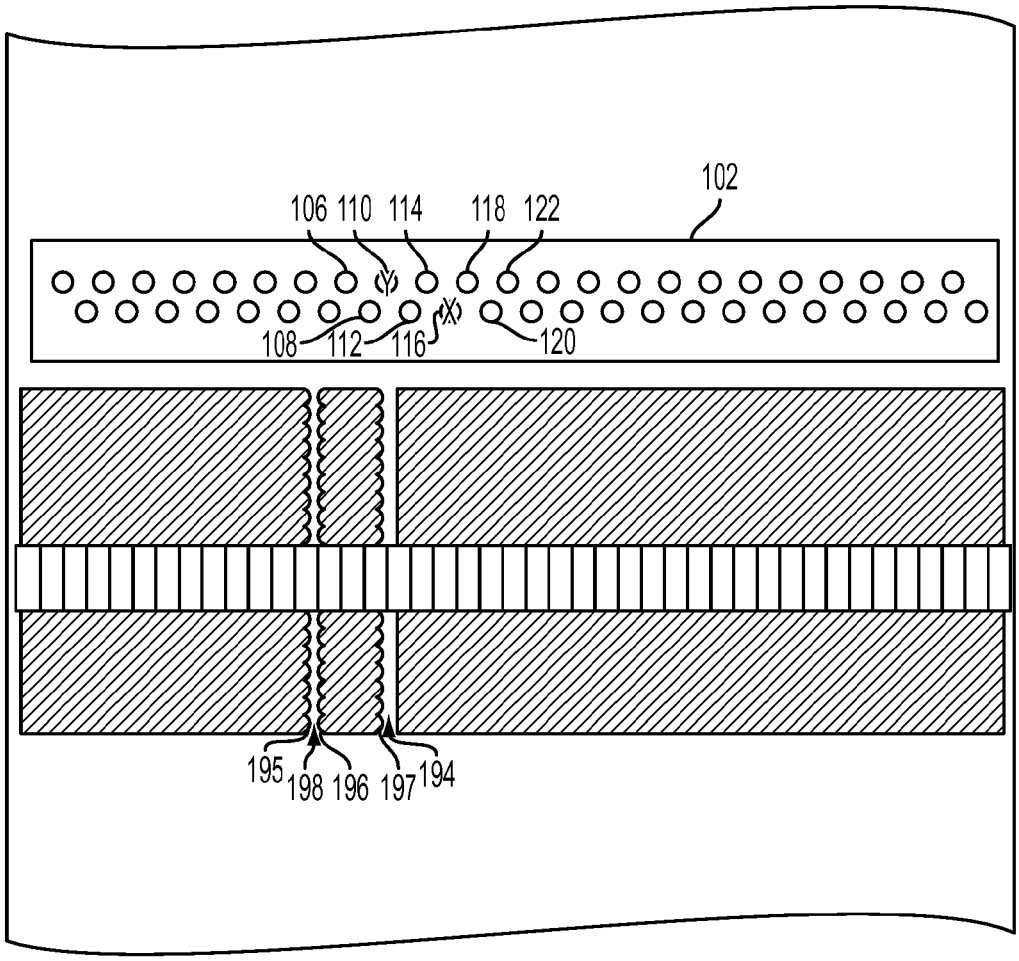
FIG. 5B is schematic view of FIG. 5A after compensating for the inoperable inkjet with an incorrect inkjet.

In FIG. 3A, the candidate inkjet 118 is offset from the inoperable inkjet 116 by a span of one pixel in the cross-process direction. FIG. 4A depicts another situation where a candidate inkjet 120 is offset from the inoperable inkjet 116 by two pixels, and FIG. 5B depicts yet another situation where a candidate inkjet 110 is offset from the inoperable inkjet 116 by three pixels. In FIG. 4A, a light sensor 162 detects a light streak 184 that corresponds to candidate inkjet 124. In FIG. 5A, a light sensor 163 detects a light streak 194 that corresponds to candidate inkjet 110. The direction of the error can be either to the left or to the right in the cross-process direction. While errors between the candidate inkjet and the inoperable inkjet of up to three pixels are illustrated herein, alternative printer configurations detect and correct for larger offset errors as well.

After identification of a candidate inkjet, process 200 deactivates the candidate inkjet and optionally compensates for the deactivated candidate inkjet with neighboring inkjets (block 216). For example, in FIG. 3A the controller 50 deactivates the candidate inkjet 118 and attempts to compensate for the candidate inkjet 118 by operating inkjets 114, 116, 120, and 122 at an increased rate when the print job would operate inkjet 118, if the inkjet was operable. The deactivation of an inoperable inkjet and alternative activation of neighboring inkjets to compensate for the loss of the inoperable inkjet is referred to as an "inkjet substitution" operation. While the neighboring inkjets depicted in FIG. 3A are in the same printhead 102 and the inoperable inkjet, inkjet printers that employ interleaved printheads, such as the printer 5, can also substitute inkjets in one or more interleaved printheads that are proximate to the inoperable inkjet in the cross-process direction. In an alternative embodiment, the printer 5 deactivates the candidate inkjet, but does not begin compensating with the neighboring inkjet until process 200 has identified a candidate inkjet that is in fact the inoperable inkjet. Delaying the operation of the neighboring inkjets to compensate for the deactivated candidate inkjet can result in an ink image that more clearly depicts the light streak generated from deactivation of the candidate inkjet if the candidate inkjet is not the inoperable inkjet. Compensating with the neighboring inkjets as the candidate inkjet is deactivated reduces the perceptibility of the image defect generated when the deactivated candidate inkjet is not the correct inkjet.

When the correct inoperable inkjet is identified, the operation of the neighboring inkjets reduces or eliminates the visual impact of the light streak that is generated by the inoperable inkjet. The printer 5 continues printing ink images and the optical imaging system 54 generates additional second image data for ink images that are printed after the printer 5 begins compensating for the candidate inkjet (block 220).

In some cases, process 200 identifies an incorrect candidate inkjet and the compensation for the incorrectly identified candidate inkjet results in a second image defect. The controller 50 identifies a second image defect that is proximate to the first identified image defect in the additional image data of ink images that are printed after compensation for the candidate inkjet (block 224). In the examples of FIG. 3A, FIG. 4A, and FIG. 5A, an identified candidate inkjet is actually an operational inkjet, while the inoperable inkjet 116 is not identified as being inoperable after the detection of the first image defect. Consequently, the deactivation of the candidate inkjet generates a second image defect in addition to the image defect generated by the inoperable inkjet 116. For example, in FIG. 3B the deactivation of the candidate inkjet 118 results in a light streak 176 that is wider than the original light streak 174 because adjacent inkjets 116 and 118 are inoperable and deactivated, respectively. The light streak 176 is a larger visible image defect that has a greater negative impact on image quality than the original light streak 174. Inkjet 114 ejects additional ink drops 178 and inkjets 120 and 122 eject additional ink drops 180 to compensate for the missing inkjets, but the misidentification of the candidate inkjet 118 still results in the larger light streak 176.

Figure 3B:
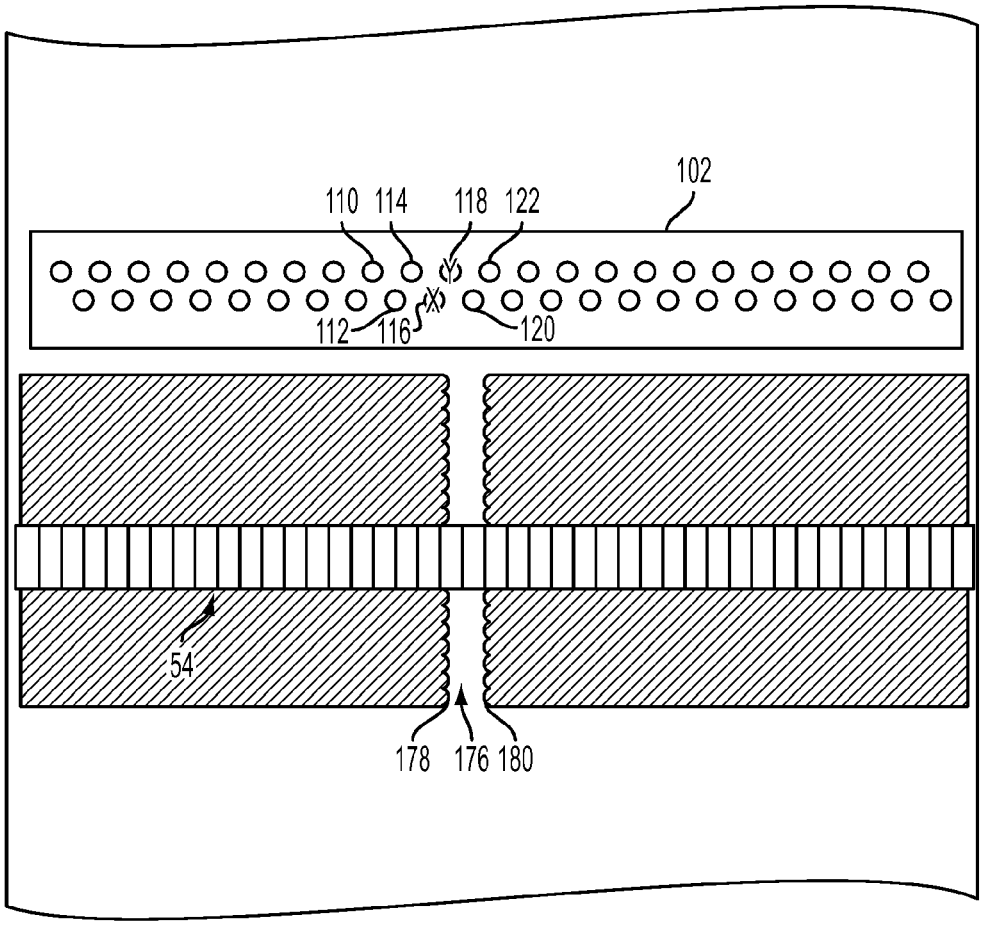
FIG. 3B is schematic view of FIG. 3A after compensating for the inoperable inkjet with an incorrect inkjet.
Figure 4B:
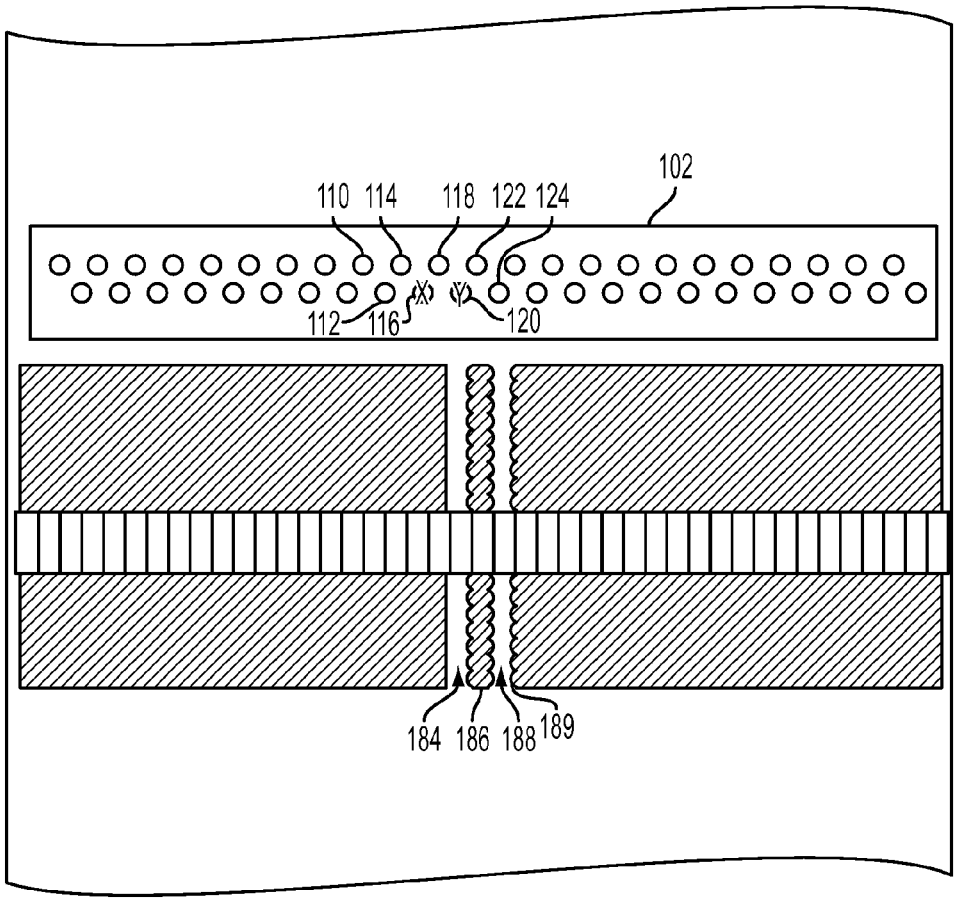
FIG. 4B is schematic view of FIG. 4A after compensating for the inoperable inkjet with an incorrect inkjet.

In FIG. 4B, the candidate inkjet 120 is deactivated and the compensation for the inkjet 120 produces the original light streak 184 of FIG. 4A and a second light streak 188. The operable inkjet 118 attempts to compensate for the light streak 188 and as a byproduct the operable inkjet 118 also partially compensates for the light streak 184. Inkjet 118 forms ink drops 186 between the light streaks 184 and 188. Operable inkjets 122 and 124 also partially compensate for the deactivated inkjet 120 as depicted by ink drops 189. Thus, FIG. 4B depicts the generation of two light streaks 184 and 188. The overall perceptible degradation in image quality in FIG. 4B is still greater than in FIG. 4A due to the misidentification of the inoperable inkjet 116, but the perceptible degradation is less than the combined light streak 176 that is depicted in FIG. 3B.

In FIG. 5B, the candidate inkjet 110 is deactivated and the compensation for the inkjet 110 produces a light streak 198 in addition to the light streak 194 of FIG. 5A. In FIG. 5B, the inkjets 106 and 108 produce ink drops 195 that partially compensate for the light streak 194 from the left side in the cross-process direction. Inkjets 112 and 114 produce ink drops 196 to compensate for the light streak 198 from the right side in the cross-process direction. Inkjets 112 and 114 also produce ink drops 197, which partially compensate for the light streak 194 from the left side. Thus, FIG. 5B depicts the generation of two light streaks 194 and 198. While the overall degradation in image quality in FIG. 5B is greater than in FIG. 5A due to the misidentification of the inoperable inkjet 116, the overall negative impact on image quality is less than in FIG. 3B and in FIG. 4B for at least two reasons. First, in FIG. 5B the deactivated inkjet 110 is fully compensated by two operational inkjets 106 and 108 on the left side and 112 and 114 on the right side, and the first light streak 194 is partially compensated by inkjets 112 and 114 on the left side. Second, the cross-process direction distance between the two light streaks 194 and 198 is greater in FIG. 5B than in FIG. 3B and in FIG. 4B, which reduces the combined impact of the two light streaks on perceived image quality.

In combination, the examples of FIG. 3A-FIG. 5A and FIG. 3B-FIG. 5B each depict additional image degradation generated by correction of a misidentified inkjet that is near an inoperable inkjet. The degree of image degradation is, however, inversely related to the offset between the candidate inkjet and the inoperable inkjet, since the single-pixel error depicted in FIG. 3A and FIG. 3B generates the greatest negative impact on image quality, while the three-pixel error in FIG. 5A and FIG. 5B generates the least negative impact on image quality. To reduce the likelihood of a single-pixel error in inkjet identification, one embodiment of process 200 includes a predetermined offset in the cross-process direction that is applied to the candidate inkjet in block 212. Using FIG. 3A as an example, the controller 50 selects a candidate inkjet other than inkjet 118 that nominally aligns with the light streak 174 detected by the light sensor 160.

In one example of a predetermined offset using FIG. 3A, instead of selecting inkjet 118 as the candidate inkjet, the controller 50 selects a candidate inkjet that is offset from inkjet 118 by a predetermined number of pixels in the cross-process direction. For example, process 200 can offset by four pixels to the left in the cross-process direction to select pixel 110 as a candidate pixel instead of pixel 118. In printer configurations where single-pixel errors in identification of inoperable inkjets are common, the predetermined offset reduces the likelihood of deactivating an inkjet that is adjacent to the actually inoperable inkjet, and reduces the total negative impact on image quality due to misidentification of the inoperable inkjet. As described below, the controller 50 can optionally store cross-process direction offset values of previously identified inoperable inkjets in a memory. If an earlier identified inoperable inkjet is proximate to the newly identified light streak, then the controller 50 can use the same offset value stored in the memory to identify a candidate inkjet at the previously identified cross-process direction offset with reference to the cross-process direction location of the light streak in the image data.

Referring again to FIG. 1, process 200 continues by identifying the actual inkjet that generated the first image defect with reference to the magnitude and cross-process location of the first and second image defects (block 228). When process 200 deactivates an incorrect candidate inkjet, the cross-process direction position of the second image defect provides information on the offset between the incorrectly identified candidate inkjet, and the actual inkjet that is inoperable. While the cross-process direction location of the inoperable inkjet is not immediately identified, the controller 50 has stored information of the expected cross-process direction location of the deactivated candidate inkjet. Process 200 identifies the inoperable inkjet with reference to the magnitude and direction of offset between the first image defect and the second image defect in the image data.

Figure 6A:
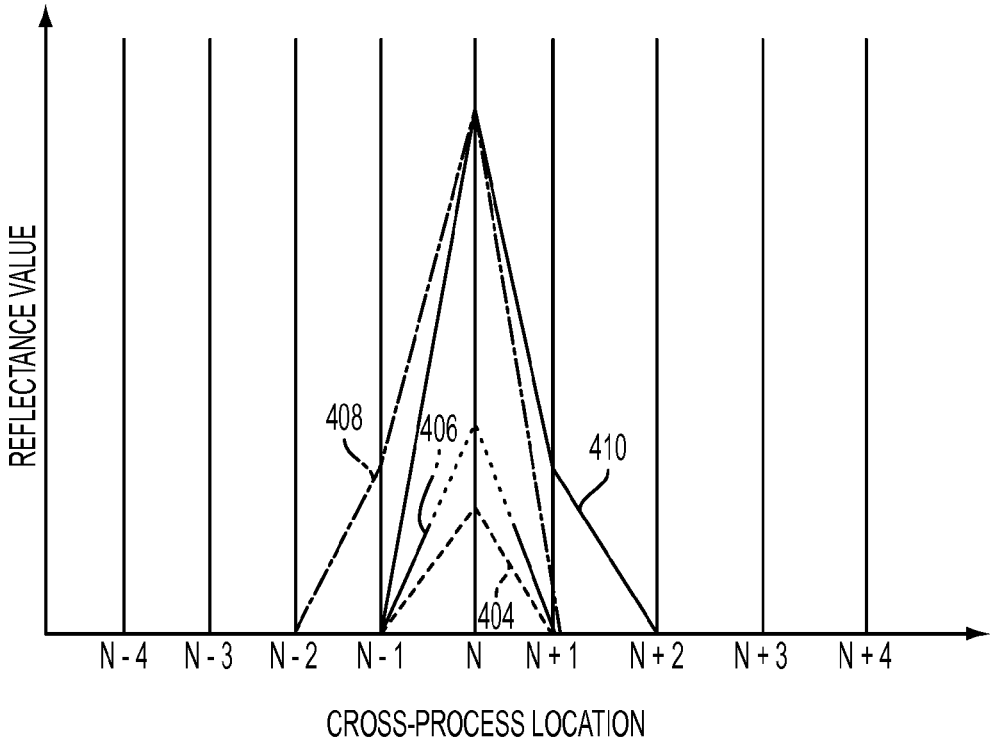
FIG. 6A is a graphical depiction of reflectance values in image data generated when inkjets that are adjacent to an inoperable inkjet are deactivated.

For example, FIG. 6A is a graph of reflectance values for pixel locations centered about a detected light streak 406 at location N. The reflectance graph 404 depicts an expected relative reflectance when the correct inoperable inkjet (inkjet 116 in FIGS. 3A and 3B) is identified and compensated during a print job. The reflectance graph 410 depicts the configuration of FIG. 3B where process 200 compensates for the candidate inkjet 118 that is located at pixel position N+1. The highest peak of the reflectance graph 410 occurs at pixel position N, and a "knee" in the reflectance graph occurs at location N+1 due to the deactivation of inkjet 118. The comparative magnitude and positions of the graph 410 indicate that the candidate inkjet is located one pixel 118 to the right of the inoperable inkjet 116. Similarly, graph 408 depicts a situation in which the candidate inkjet (inkjet 114 in FIG. 3B) is located one pixel to the left of the inoperable inkjet at pixel position N−1. In graph 408, the reflectance value at pixel N is approximately the same as in graph 410, but the knee in the reflectance graph is located at pixel N−1 to account for the deactivated inkjet 114.

Figure 6B:
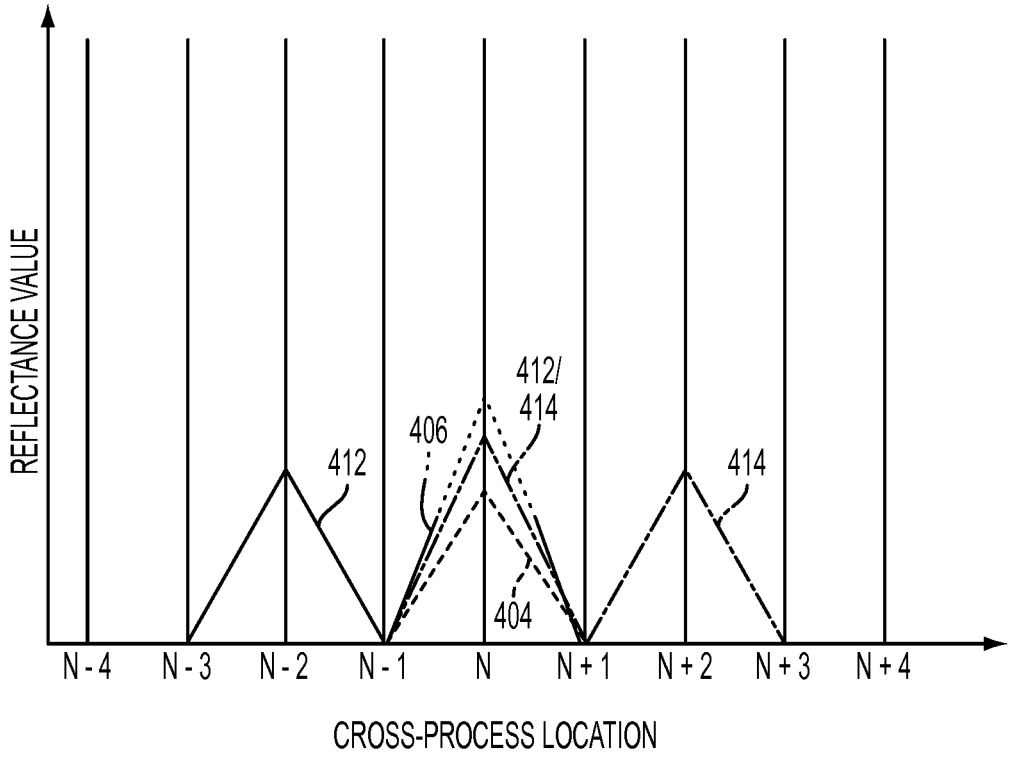
FIG. 6B is a graphical depiction of reflectance values in image data generated when inkjets that are offset from an inoperable inkjet by a span of two pixels are deactivated.

FIG. 6B depicts a graph of reflectance values around a detected light streak 406 at pixel location N when the candidate pixel offset by two pixels in the cross-process direction from the inoperable pixel. Graph 412 depicts a situation where the candidate inkjet (inkjet 112 in FIG. 4B) is located two pixels to the left of the inoperable inkjet 116 in the cross-process direction. In graph 412, a reflectance peak at location N−2 represents a partially compensated light streak generated by the deactivated inkjet 108, and a light streak at location N represents the partial compensation at pixel location N. Graph 414 depicts the situation of FIG. 4B where the candidate inkjet (inkjet 120 in FIG. 4B) is located two pixels to the right of the inoperable inkjet 116 in the cross-process direction. In graph 414, a reflectance peak at location N+2 represents a partially compensated light streak generated by the deactivated inkjet 120, and a light streak at location N represents the partial compensation at pixel location N of the inoperable inkjet 116.

Figure 6C:
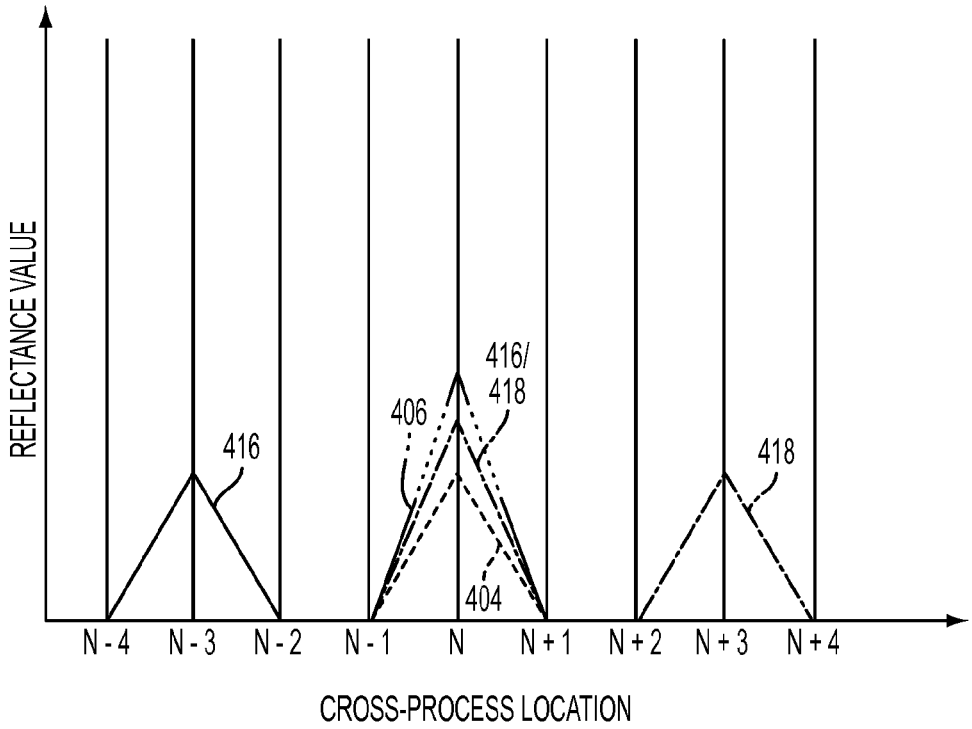
FIG. 6C is a graphical depiction of reflectance values in image data generated when inkjets that are offset from an inoperable inkjet by a span of three pixels are deactivated.

FIG. 6C depicts a graph of reflectance values around a detected light streak 406 at pixel location N when the candidate pixel offset by three pixels in the cross-process direction from the inoperable pixel. Graph 416 depicts a situation where the candidate inkjet (inkjet 110 in FIG. 5B) is located three pixels to the left of the inoperable inkjet 116 in the cross-process direction. In graph 416, a reflectance peak at location N−3 represents a fully compensated light streak generated by the deactivated inkjet 110, and a light streak at location N represents the partial compensation at pixel location N. The reflectance peak at location N−3 is fully compensated because the embodiment of FIG. 5B compensates for an inoperable inkjet with two neighboring inkjets on either side of the inoperable inkjet in the cross-process direction, which are inkjets 106, 108, 112, and 114 for the candidate inkjet 110. Graph 418 depicts the situation of FIG. 5B where the candidate inkjet (inkjet 122 in FIG. 5B) is located three pixels to the right of the inoperable inkjet 116 in the cross-process direction. In graph 418, a reflectance peak at location N+3 corresponds to the fully compensated light streak generated by the deactivated inkjet 122, and a light streak at location N represents the partial compensation at pixel location N of the inoperable inkjet 116.

As depicted in FIG. 6A-FIG. 6C, the deactivation and compensation for each of the incorrect candidate inkjets illustrated above produces an identifiable set of reflectance data. Referring again to FIG. 1, in process block 228, the controller 50 identifies the inoperable inkjet with reference to the reflectance values of the original image defect and the new image defect. In one embodiment, the controller 50 retrieves predetermined data corresponding to the reflectance values for a range of potential incorrect identifications of an inoperable inkjet from the memory, such as data corresponding to the reflectance value graphs depicted in FIG. 6A-FIG. 6C. The controller 50 identifies the predetermined reflectance values that most closely correspond to the additional image data that include the new image defect, and identifies the inoperable inkjet with reference to the combination of the original image defect and the new image defect.

After identification of the inoperable inkjet with reference to the second image data, the controller 50 reactivates the previously deactivated candidate inkjet and returns inkjets neighboring the candidate inkjet to a normal mode of operation (block 232). The controller also deactivates the newly identified inoperable candidate inkjet, and compensates for the inoperable candidate inkjet by activating neighboring inkjets around the inoperable inkjet (block 236).

In an alternative configuration, process 200 identifies the inoperable inkjet in an iterative manner instead of identifying the inoperable inkjet with reference to a single additional image defect generated by one candidate inkjet. In an iterative configuration, process 200 generates additional image data (block 220) after selecting a new candidate inkjet (block 236). Process 200 continues selecting new candidate inkjets until the candidate inkjet is the inoperable inkjet and the image data do not include a second image defect (block 224) or until process 200 identifies the offset between successive light streaks generated by candidate inkjets and the original light streak generated by the inoperable inkjet. In the alternative configuration, the candidate inkjets can be selected with a minimum offset from an expected range of the inoperable inkjet to minimize the likelihood of selecting a candidate inkjet that is adjacent to the inoperable inkjet, as depicted in FIG. 3A and FIG. 3B. For example, process 200 progresses through inkjets that are in a range of [−10, −4] inkjet positions to the left and [4, 10] inkjet positions to the right of the identified location of the original light streak in the cross-process direction. In the alternative configuration, the controller 50 identifies the inoperable inkjet with reference to multiple cross-process direction distances between the original image defect and the light streaks that are introduced by deactivation of different inkjets around the inoperable inkjet. In another alternative, the candidate inkjet is only partially deactivated in the processing described in block 216. The partial deactivation and correction by neighboring inkjets is chosen so to generate a detectable artifact in the printed image, such as a light streak. This action provides the desired functionality with a reduced degradation of the printed image.

While process 200 addresses situations in which an inoperable inkjet is misidentified, in many cases the candidate inkjet identified in process block 212 is in fact the inoperable inkjet. When the inoperable inkjet is correctly identified, the magnitude of the light streak decreases as depicted by reflectance graph 404 in FIG. 6A-FIG. 6C. If the inoperable inkjet is correctly identified, then the additional image data do not include a second image defect (block 224) and the neighboring inkjets around the inoperable inkjet continue to compensate for the inoperable inkjet (block 240).

After identification of the inoperable inkjet, process 200 can optionally store a cross-process direction offset between an original candidate inkjet and the inoperable inkjet (block 244). In the printer 5, the controller 50 stores the offset value in a memory. In situations where the originally identified candidate inkjet is the inoperable inkjet, the offset value is zero, and in one embodiment the offset value has a positive or negative value to indicate the relative left or right direction of the offset in the cross-process direction. The stored offset value in the memory can be used to improve the accuracy of identifying the location of another inoperable inkjet that is proximate to an earlier identified inoperable inkjet in the cross-process direction. The offset values between the apparent and actual locations of inoperable inkjets can vary across the width of the print zone 20 due to various factors including different degrees of media web shrinkage across the width of the media web W and variations in the alignment of the optical imaging system 54. Consequently, the controller 50 has access to stored offset values corresponding to inoperable inkjets that are identified in different regions of the print zone, and if another inkjet in the same region becomes inoperable, the previously identified offset value can be used to identify the inoperable inkjet more quickly. Additionally the location of ink jets can be identified as an ongoing process in regions without inoperable ink jets by deactivating a known inkjet and detecting the location of a light streak or other image artifact that is generated due to deactivation of the inkjet. This information can be used to subsequently locate another inkjet that later becomes inoperable.

Figure 2:
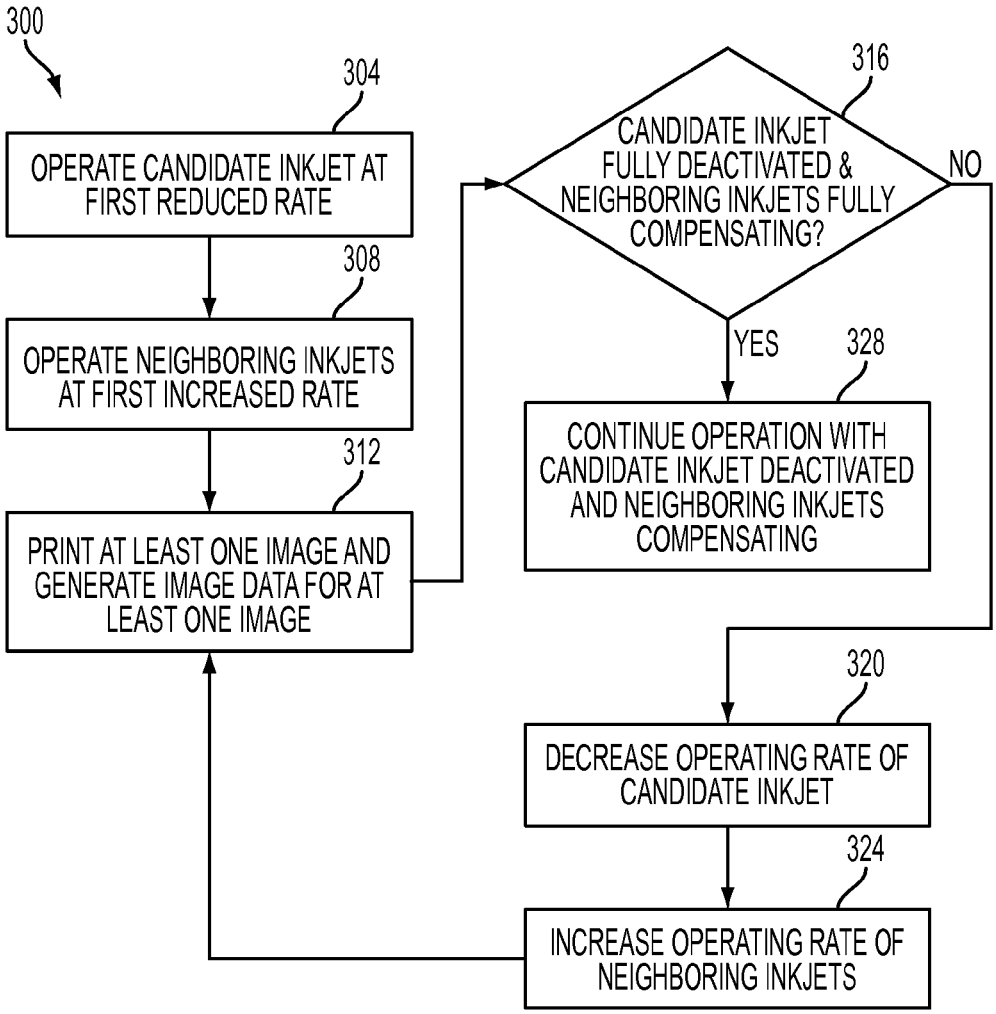
FIG. 2 is a block diagram of a process for gradually activating and deactivating inkjets in an inkjet printer.

As described above, process 200 selectively deactivates inkjets and also operates neighboring inkjets to compensate for inoperable inkjets during a print job. Process 200 also identifies when a deactivated candidate inkjet is not actually an inoperable inkjet and then identifies the actually inoperable inkjet. In one embodiment, process 200 fully deactivates a candidate inkjet and activates the surrounding inkjets to compensate for the deactivated inkjet in a binary, or on/off manner. The binary activation and deactivation compensates for an inoperable inkjet quickly, but when process 200 misidentifies an inoperable inkjet, the deactivation of the incorrect inkjet also produces a second image defect. FIG. 2 depicts a process 300 for fractional compensation of an inkjet that gradually deactivates a candidate inkjet and gradually activates neighboring inkjets. In the discussion below, a reference to the process performing a function or action refers to a controller executing programmed instructions stored in a memory to operate one or more components of the printer to perform the function or action. Process 300 can be incorporated into process 200 described above. Process 300 is described with reference to printer 5 and controller 50 for illustrative purposes.

Process 300 begins by operating a candidate inkjet at a first reduced rate (block 304) and operating neighboring inkjets at a first increased rate (block 308). In the printer 5, the controller 50 generates firing signals for the inkjets in the print zone 20 to form ink images on the media web W. In one configuration of process 300, the controller 5 generates only 90% of the firing signals that would normally be generated for a candidate inkjet, and also generates 10% more firing signals for neighboring inkjets to compensate for the candidate inkjet. The controller 50 times the increased frequency of firing signals for the neighboring inkjets to correspond to times at which firing signals are not being generated for the candidate inkjet. Process 300 prints at least one ink image, and in some configurations multiple ink images with the partially deactivated candidate inkjet and the partially compensating neighboring inkjets (block 312).

Process 300 continues incrementally while the candidate inkjet operates in a partially activated move and the neighboring inkjets partially compensate for the candidate inkjet (block 316). Process 300 continues to decrease the operating rate of the candidate inkjet (block 320) and increase the operating rate of neighboring inkjets (block 324) incrementally. After each adjustment to the candidate and neighboring inkjets, the printer 5 prints at least one additional ink image (block 312). After a predetermined number of iterations, the candidate inkjet is fully deactivated and the neighboring inkjets are fully activated (block 316). The printer 5 then continues operation with the candidate inkjet completely deactivated and with the neighboring inkjets fully compensating for the deactivated inkjet (block 328). The gradual deactivation of the candidate inkjet in process 300 enables the controller 50 to identify a second image defect in the printed ink image with the optical sensor system 54 before the image defect grows large enough to be noticeable to the naked eye in printed images.

When the printer 5 performs process 300 in conjunction with process 200, the controller 50 is configured to interrupt process 300 at any time if process 200 identifies the candidate inkjet as not being the inoperable inkjet. In one embodiment, the controller 50 generates a numeric confidence score from the image data generated after each iteration of process 300. As used herein, the term "confidence score" refers to a numeric value that is generated based on an estimation that candidate inkjet is in fact the inoperable inkjet. For example, the detected amplitude of light streaks by the optical sensor can be used as a measure of confidence score. If the deactivation of an inkjet yields a light streak with a smaller amplitude than the amplitude before the deactivation, then the confidence score has a higher value. Alternatively, if the deactivation of an inkjet yields a light streak with a larger amplitude of light streak then the amplitude before the deactivation, then the confidence score has a lower value.

In one configuration, the confidence score is expressed as a percentage value between 0% and 100%. As process 300 gradually deactivates the candidate inkjet and gradually increases the compensation of the neighboring inkjets to compensate, the adjustment to the operation of the inkjets typically drives the confidence score to higher or lower values. For example, if the candidate inkjet is also the inoperable inkjet, the confidence score increases towards 100% as the neighboring inkjets compensate for the inoperable inkjet. If the candidate inkjet is not the inoperable inkjet, then the confidence score decreases towards 0% as the deactivation of an operational inkjet produces another image defect with progressively greater impact on the image quality.

In the printer 5, the controller 50 is configured to interrupt process 300 if the confidence value drops below a predetermined threshold value prior to completely deactivating the candidate inkjet to reduce the impact on image quality. In some embodiments, the controller 50 also identifies that the candidate inkjet is the inoperable inkjet if the confidence value exceeds a higher threshold, even if the candidate inkjet has not been fully deactivated. The controller 50 interrupts process 300, fully deactivates the candidate inkjet, and fully compensates for the candidate inkjet with the neighboring inkjets. Thus, process 300 can be interrupted to reduce the impact on image quality when the candidate inkjet is not the inoperable inkjet, and to compensate for an inoperable inkjet more quickly when the candidate inkjet is the inoperable inkjet.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method of compensating for defects in printed images comprising:

generating image data corresponding to a first printed image formed by a plurality of inkjets arranged in a cross-process direction in a printer;

identifying a first defect in the first printed image with reference to the image data of the first printed image;

identifying a candidate inkjet that generated the first defect with reference to a cross-process direction location of the first defect in the image data of the first printed image;

modifying operation of the candidate inkjet to form a second printed image;

generating image data corresponding to the second printed image;

identifying that a second inkjet in the plurality of inkjets other than the candidate inkjet generated the first defect in response to a second cross-process direction location of a second defect identified in the image data of the second printed image being within a predetermined cross-process direction distance of the cross-process direction location of the first defect;

operating the candidate inkjet in an original mode of operation in response to the second inkjet being identified; and modifying operation of the second inkjet in the cross-process direction to form a third printed image.

2. The method of claim 1 further comprising:

modifying the operation of at least one other inkjet in the plurality of inkjets proximate to the candidate inkjet in the cross-process direction to form the second printed image.

3. The method of claim 2, the modification of the operation of the candidate inkjet and the at least one other inkjet proximate to the candidate inkjet further comprising:

operating the candidate inkjet with a first reduced frequency to form the second printed image;

operating the at least one other inkjet proximate to the candidate inkjet with a first increased frequency to form the second printed image;

generating a score corresponding to a confidence that the candidate inkjet generates the first defect with reference to the image data of the second printed image; and identifying that the second inkjet in the plurality of inkjets other than the candidate inkjet generated the first defect in the first printed image in response to the confidence score being below a predetermined threshold.

4. The method of claim 1 further comprising:

generating image data corresponding to the third printed image; and identifying that a third inkjet in the plurality of inkjets other than either of the candidate inkjet and the second inkjet generated the first defect in response to a third cross-process direction location of a third defect identified in the image data of the third printed image being within the predetermined cross-process direction distance of at least one of the cross-process direction location of the first defect and the cross-process direction location of the second defect.

5. The method of claim 4, the modification of the operation of the second inkjet further comprising:

deactivating the second inkjet.

6. The method of claim 1, wherein the second inkjet in the plurality of inkjets is identified as being adjacent to the candidate inkjet in the cross-process direction in response to a magnitude of the second defect being greater than a magnitude of the first defect.

7. The method of claim 1, wherein the second inkjet in the plurality of inkjets is identified as being offset from the candidate inkjet by a cross-process direction distance corresponding to a cross-process direction offset between the cross-process direction location of the first defect and the cross-process direction location of the second defect.

8. The method of claim 1 further comprising:

storing a value corresponding to a cross-process direction offset between the second inkjet and the candidate inkjet in a memory;

generating image data corresponding to a third printed image printed by the plurality of inkjets in the printer;

identifying a third defect in the third printed image with reference to the image data of the third printed image; and identifying a second candidate inkjet that generated the third identified defect with reference to a cross-process direction location of the third defect in the image data of the third printed image and the value corresponding to the cross-process direction offset between the second inkjet and the candidate inkjet in the memory.

9. The method of claim 1, the first identified image defect being a light streak.

10. The method of claim 1, the identification of the candidate inkjet further comprising:

identifying an inkjet in the plurality of inkjets that corresponds to the cross-process direction location of the first defect in the image data of the first printed image; and identifying the candidate inkjet as an inkjet that is offset from the inkjet that corresponds to the cross-process direction location of the first defect by a predetermined offset in the cross-process direction.

11. An inkjet printing apparatus comprising:

a plurality of inkjets arranged in a cross-process direction across a print zone, each inkjet being configured to eject ink drops onto an image receiving surface moving past the plurality of inkjets in a process direction;

a plurality of optical detectors configured in the cross-process direction across the image receiving surface, each optical detector in the plurality of optical detectors being configured to detect light reflected from the image receiving surface; and a controller operatively connected to the plurality of inkjets and the plurality of optical detectors, the controller being configured to:

generate a first plurality of firing signals to eject ink from the plurality of inkjets onto the image receiving member to form a first printed image;

generate image data corresponding to the first printed image with the plurality of optical detectors;

identify a first defect in the first printed image with reference to the image data;

identify a candidate inkjet that generated the first defect with reference to a cross-process direction location of the first defect in the image data;

modify generation of firing signals for the candidate inkjet in the cross-process direction to eject ink from the plurality of inkjets onto the image receiving surface to form a second printed image;

generate image data corresponding to the second printed image with the plurality of optical detectors;

identify that a second inkjet in the plurality of inkjets other than the candidate inkjet generated the first defect in response to a second cross-process direction location of a second defect identified in the image data of the second printed image being within a predetermined cross-process direction distance of the cross-process direction location of the first defect;

generate firing signals for the candidate inkjet in an unmodified manner in response to identification of the second inkjet; and modify generation of firing signals for the second inkjet to eject ink from the plurality of inkjets onto the image receiving surface to form a third printed image.

12. The inkjet printing apparatus of claim 11, the controller being further configured to:

modify generation of firing signals for at least one other inkjet in the plurality of inkjets proximate to the candidate inkjet in the cross-process direction to form the second printed image.

13. The inkjet printing apparatus of claim 12, the controller being further configured to:

generate a reduced number of firing signals for the candidate inkjet to form the second printed image;

generate an increased number of firing signals for at least one inkjet proximate to the candidate inkjet in the cross-process direction to form the second printed image;

generate a score corresponding to a confidence that the candidate inkjet generates the first defect with reference to the second image data; and identify that the second inkjet in the plurality of inkjets other than the candidate inkjet generated the first defect in the first printed image in response to the confidence score being below a predetermined threshold.

14. The inkjet printing apparatus of claim 11, the controller being further configured to:

generate image data corresponding to the third printed image with the plurality of optical detectors; and identify that a third inkjet in the plurality of inkjets other than either of the candidate inkjet and the second inkjet generated the first defect in response to a third cross-process direction location of a third defect identified in the image data of the third printed image being within the predetermined cross-process direction distance of at least one of the cross-process direction location of the first defect and the cross-process direction location of the second defect.

15. The inkjet printing apparatus of claim 11, wherein the controller generates no firing signals for the second inkjet during printing of the third printed image.

16. The inkjet printing apparatus of claim 11, wherein the controller identifies the second inkjet as being adjacent to the candidate inkjet in the cross-process direction in response to a magnitude of the second defect being greater than a magnitude of the first defect.

17. The inkjet printing apparatus of claim 11, wherein the controller identifies the second inkjet in the plurality of inkjet as being offset from the candidate inkjet by a cross-process direction distance corresponding to a cross-process direction offset between the cross-process direction location of the first defect and the cross-process direction location of the second defect.

18. The inkjet printing apparatus of claim 12 further comprising:

a memory communicatively coupled to the controller; and the controller being further configured to:

store a value corresponding to a cross-process direction offset between the second inkjet and the candidate inkjet in the memory;

generate a third plurality of firing signals to eject ink from the plurality of inkjets onto the image receiving member to form a third printed image;

generate image data corresponding to the third printed image with the plurality of optical detectors;

identify a third defect in the third printed image with reference to the image data of the third printed image; and identify a second candidate inkjet that generated the third defect with reference to a cross-process direction location of the third defect in the image data and the value corresponding to the cross-process direction offset between the second inkjet and the candidate inkjet in the memory.

19. The inkjet printing apparatus of claim 11, the first identified image defect being a light streak.

20. The inkjet printing apparatus of claim 11, the controller being further configured to:

identify an inkjet in the plurality of inkjets that corresponds to the cross-process direction location of the first defect in the image data of the first printed image; and identify the candidate inkjet as an inkjet that is offset from the inkjet that corresponds to the cross-process direction location of the first defect by a predetermined offset in the cross-process direction.

* * * * *